US010905214B1

(12) United States Patent
Wieclaw

(10) Patent No.: US 10,905,214 B1
(45) Date of Patent: Feb. 2, 2021

(54) CLOTHING CONTAINER AND RACK

(71) Applicant: ELK Promotions, Inc., Columbus, OH (US)

(72) Inventor: Scott Alan Wieclaw, Galena, OH (US)

(73) Assignee: ELK Promotions, Inc., Columbus, OH (US)

( * ) Notice: Subject to any disclaimer, the term of this patent is extended or adjusted under 35 U.S.C. 154(b) by 0 days.

(21) Appl. No.: 16/783,116

(22) Filed: Feb. 5, 2020

(51) Int. Cl.

| | |
|---|---|
| ***A45C 13/04*** | (2006.01) |
| ***A45C 13/03*** | (2006.01) |
| ***B65D 21/08*** | (2006.01) |
| ***A45C 5/03*** | (2006.01) |
| ***A45C 7/00*** | (2006.01) |
| ***A45C 9/00*** | (2006.01) |
| *A45C 13/02* | (2006.01) |

(52) U.S. Cl.
CPC ..... *A45C 13/03* (2013.01); *A45C 5/03* (2013.01); *A45C 7/0036* (2013.01); *A45C 9/00* (2013.01); *A45C 13/04* (2013.01); *B65D 21/086* (2013.01); *A45C 2013/026* (2013.01)

(58) Field of Classification Search
CPC ... A45C 13/03; A45C 2013/026; A45C 13/04; A45C 7/0036; B65D 21/086
USPC ..... 190/107; 206/279; 220/7
See application file for complete search history.

(56) References Cited

U.S. PATENT DOCUMENTS

| | | | |
|---|---|---|---|
| 4,674,647 | A | 6/1987 | Gyenge et al. |
| 4,895,230 | A | 1/1990 | King |
| 5,515,987 | A | 5/1996 | Jacques et al. |
| 5,529,156 | A | 6/1996 | Yang |
| 6,073,790 | A | 6/2000 | Umiker |
| 6,443,274 | B1 | 9/2002 | Klamm |
| 6,460,717 | B1 | 10/2002 | Smyers et al. |
| 6,926,129 | B2 | 8/2005 | Hoberman |
| 7,607,535 | B2 | 10/2009 | Jackson |

(Continued)

FOREIGN PATENT DOCUMENTS

| | | | |
|---|---|---|---|
| EP | 3339205 | A1 | 6/2018 |
| WO | 2018043837 | A1 | 3/2018 |

OTHER PUBLICATIONS

"Heavy duty plastic collapsing vegetable folding crate", Alibaba Website, Web page <https://www.alibaba.com/product-detail/Heavy-duty-plastic-collapsing-vegetable-folding_62036791551.html?spm=a2700.7724857.nor-malList.16.471f18e5IHNkqA&s=p&fullFirstScreen=true>, 10 pages, dated at least as early as Apr. 14, 2019, retrieved from www.alibaba.com website on Apr. 23, 2020.

(Continued)

*Primary Examiner* — Sue A Weaver
(74) *Attorney, Agent, or Firm* — The Law Office of Patrick F. O'Reilly III, LLC

(57) ABSTRACT

A clothing container and rack is disclosed herein. The clothing container and rack includes a collapsible crate having a plurality of collapsible side panels pivotably coupled to a bottom portion, the collapsible crate defining an interior cavity for holding one or more items of apparel; and a clothing rack configured to be attached to the collapsible crate, the clothing rack including a clothes rod for hanging one or more items of clothing. In one or more further embodiments, the clothing container and rack further includes a suitcase housing disposed around the collapsible crate, the collapsible crate forming at least a portion of a suitcase frame supporting the suitcase housing.

20 Claims, 16 Drawing Sheets

(56) References Cited

U.S. PATENT DOCUMENTS

| | | | | |
|---|---|---|---|---|
| 8,820,777 | B1 * | 9/2014 | Pargansky | B62B 3/022 280/651 |
| 9,296,514 | B2 | 3/2016 | Ficker | |
| 9,565,932 | B2 | 2/2017 | Hirsch | |
| D801,686 | S | 11/2017 | Park | |
| 9,820,542 | B2 | 11/2017 | McKelvey | |
| 9,919,833 | B2 | 3/2018 | Jian et al. | |
| 2006/0022419 | A1 * | 2/2006 | Phillips, II | B62B 3/02 280/47.35 |
| 2009/0000894 | A1 * | 1/2009 | Middup | A45C 5/14 190/15 R |
| 2009/0101649 | A1 * | 4/2009 | Kuzelka | B65D 15/08 220/288 |
| 2009/0321204 | A1 | 12/2009 | Barkow et al. | |
| 2011/0120826 | A1 | 5/2011 | Middup | |
| 2016/0143406 | A1 | 5/2016 | Collins et al. | |
| 2016/0235175 | A1 * | 8/2016 | Jose | A45C 7/0036 |
| 2016/0280243 | A1 * | 9/2016 | Devers | A47G 25/0664 |
| 2017/0137175 | A1 | 5/2017 | Park | |

OTHER PUBLICATIONS

"BigAnt Smart Crate (Plastic folding box)", Alibaba Website, Web page <https://www.alibaba.com/product-detail/BigAnt-Smart-Crate-Plastic-folding-box-_50039205461.html?spm=a2700.7724838.2017115.1.1cb53d78GYI3xh&fullFirstScreen=true>, 5 pages, dated at least as early as Apr. 14, 2019, retrieved from www.alibaba.com website on Apr. 23, 2020.

"The Closet Trolley Rolling Duffel—BLACK", Closet Trolley Website, Web page <http://www.closettrolley.com/store/pc/The-Closet-Trolley-Rolling-Duffel-BLACK-3p2.htm>, 1 page, dated Mar. 19, 2017, retrieved from Internet Archive Wayback Machine <https://web.archive.org/web/20170319120226/http://www.closettrolley.com/store/pc/The-Closet-Trolley-Rolling-Duffel-BLACK-3p2.htm> on Apr. 23, 2020.

Garen Collapsible Storage Crate, Amazon Website, Web page <https://www.amazon.com/Garen-Collapsible-construction-Industrial-Strength/dp/B076BWSTSQ?ref_=fsclp_pl_dp_13>, 4 pages, dated at least as early as Apr. 14, 2019, retrieved from www.amazon.com website on Apr. 23, 2020.

* cited by examiner

Detail A

CLOTHING CONTAINER AND RACK

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a clothing container and rack. More particularly, the invention relates to a clothing container and rack that includes a collapsible crate and a clothing rack.

2. Background

In today's world, many people live in small houses, apartments, or mobile homes with little closet space for accommodating clothes. As such, clothing items are often stored in an untidy manner throughout the living space. Not only does this unorganized storage of clothing deleteriously affect the appearance of the living space, it also often results in the clothing becoming dirty and wrinkled. Also, in these small dwelling spaces, there is often inadequate hanging space for drying wet clothes after the clothes have been washed.

Also, in today's world, there are many instances where people are in need of a mobile garment rack that is able be easily transported to different locations and quickly set up. As one such example, children participating in the competition dance industry often need a mobile garment rack that keeps all clothing items and costumes readily accessible during a particular dance competition. However, due to their bulkiness and number of individual components, the accurate assembly of conventional mobile garment racks is often difficult because many of the assembly processes must be performed by hand. As such, conventional mobile garment racks are often prone to a large number of assembly defects, which results in an unacceptable number of defective products that are discarded.

Therefore, what is needed is a clothing container and rack that utilizes a collapsible crate that can be easily converted into a garment rack. Moreover, a clothing container and rack is needed that folds into a relatively thin structure for compact storage. Furthermore, there is a need for a clothing container and rack that is not susceptible to the large number of assembly defects that are experienced in the production of conventional mobile garment racks.

BRIEF SUMMARY OF EMBODIMENTS OF THE INVENTION

Accordingly, the present invention is directed to a clothing container and rack that substantially obviates one or more problems resulting from the limitations and deficiencies of the related art.

In accordance with one or more embodiments of the present invention, there is provided a clothing container and rack that includes a collapsible crate having a plurality of collapsible side panels pivotably coupled to a bottom portion, the collapsible crate defining an interior cavity for holding one or more items of apparel; and a clothing rack configured to be attached to the collapsible crate, the clothing rack including a clothes rod for hanging one or more items of clothing.

In a further embodiment of the present invention, at least a first one of the plurality of collapsible side panels of the collapsible crate comprises a bracket member and the clothing rack further comprises at least one support post, the bracket member defining an aperture for receiving a portion of the at least one support post.

In yet a further embodiment, at least a second one of the plurality of collapsible side panels of the collapsible crate comprises an aperture disposed therethrough for accommodating the bracket member of the first one of the plurality of collapsible side panels when the first one of the plurality of collapsible side panels is folded onto the second one of the plurality of collapsible side panels.

In still a further embodiment, the second one of the plurality of collapsible side panels of the collapsible crate further comprises a notch formed in a top corner of the collapsible side panel, the notch configured to allow the second one of the plurality of collapsible side panels to be folded onto the bottom portion without being obstructed by the bracket member of the first one of the plurality of collapsible side panels.

In yet a further embodiment, the bracket member is integrally formed with the first one of the plurality of collapsible side panels.

In still a further embodiment, at least a first one of the plurality of collapsible side panels of the collapsible crate comprises an upper protrusion and the bottom portion of the collapsible crate comprises a recess for accommodating the upper protrusion of the first one of the plurality of collapsible side panels when the first one of the plurality of collapsible side panels is folded onto the bottom portion of the collapsible crate.

In yet a further embodiment, the clothing container and rack further comprises a suitcase housing disposed around the collapsible crate, the collapsible crate forming at least a portion of a suitcase frame supporting the suitcase housing.

In still a further embodiment, the bottom portion of the collapsible crate comprises at least one aperture disposed in the bottom portion, the at least one aperture of the bottom portion configured to accommodate a strap for securing the collapsible crate to the suitcase housing.

In yet a further embodiment, the bottom portion of the collapsible crate comprises a plurality of foot members, the plurality of foot members configured to operate as spacers for accommodating a retractable handle structure of the suitcase housing.

In still a further embodiment, the bottom portion of the collapsible crate comprises a plurality of wheels, the plurality of wheels allowing the clothing container and rack to be more easily transported.

In yet a further embodiment, the clothing rack further comprises a pair of telescoping support posts, each of the telescoping support posts comprising a plurality of telescoping sections, and the clothes rod being configured to be supported between the telescoping support posts.

In still a further embodiment, at least one end of the clothes rod is configured to be extended beyond one of the telescoping support posts.

In accordance with one or more other embodiments of the present invention, there is provided a clothing container and rack that includes a collapsible crate having a plurality of collapsible side panels pivotably coupled to a bottom portion, the collapsible crate defining an interior cavity for holding one or more items of apparel; a clothing rack configured to be attached to the collapsible crate, the clothing rack including a clothes rod for hanging one or more items of clothing; and a suitcase housing disposed around the collapsible crate, the collapsible crate forming at least a portion of a suitcase frame supporting the suitcase housing.

In a further embodiment of the present invention, at least a first one of the plurality of collapsible side panels of the collapsible crate comprises a bracket member and the clothing rack further comprises at least one support post, the bracket member defining an aperture for receiving a portion of the at least one support post.

In yet a further embodiment, at least a second one of the plurality of collapsible side panels of the collapsible crate comprises an aperture disposed therethrough for accommodating the bracket member of the first one of the plurality of collapsible side panels when the first one of the plurality of collapsible side panels is folded onto the second one of the plurality of collapsible side panels.

In still a further embodiment, the second one of the plurality of collapsible side panels of the collapsible crate further comprises a notch formed in a top corner of the collapsible side panel, the notch configured to allow the second one of the plurality of collapsible side panels to be folded onto the bottom portion without being obstructed by the bracket member of the first one of the plurality of collapsible side panels.

In yet a further embodiment, the bracket member is integrally formed with the first one of the plurality of collapsible side panels.

In still a further embodiment, at least a first one of the plurality of collapsible side panels of the collapsible crate comprises an upper protrusion and the bottom portion of the collapsible crate comprises a recess for accommodating the upper protrusion of the first one of the plurality of collapsible side panels when the first one of the plurality of collapsible side panels is folded onto the bottom portion of the collapsible crate.

In yet a further embodiment, the bottom portion of the collapsible crate comprises at least one aperture disposed in the bottom portion, the at least one aperture of the bottom portion configured to accommodate a strap for securing the collapsible crate to the suitcase housing.

In still a further embodiment, the bottom portion of the collapsible crate comprises a plurality of foot members, the plurality of foot members configured to operate as spacers for accommodating a retractable handle structure of the suitcase housing.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
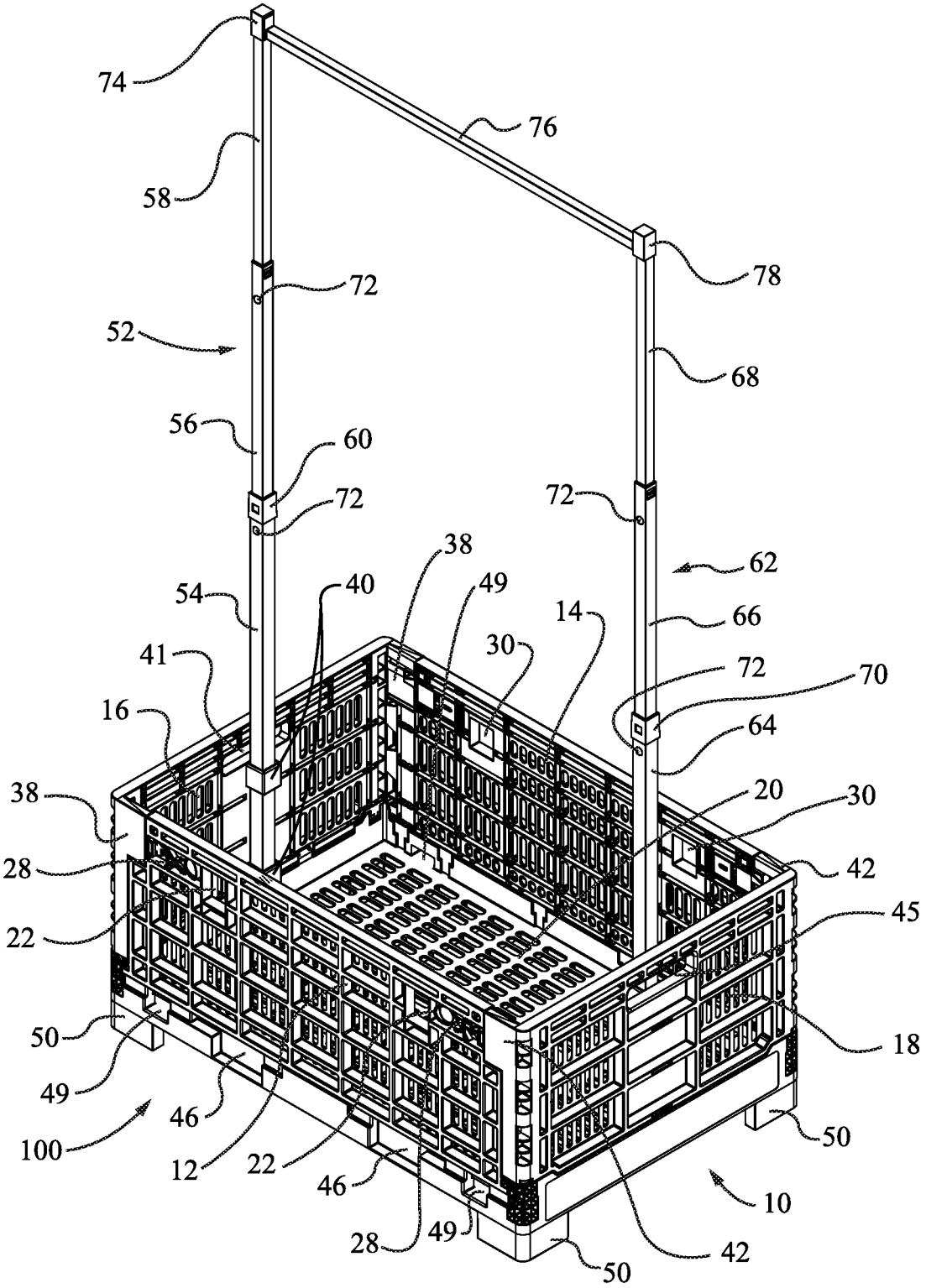
FIG. 1 is a perspective view of a clothing container and rack, according to a first illustrative embodiment of the invention.
Figure 2:
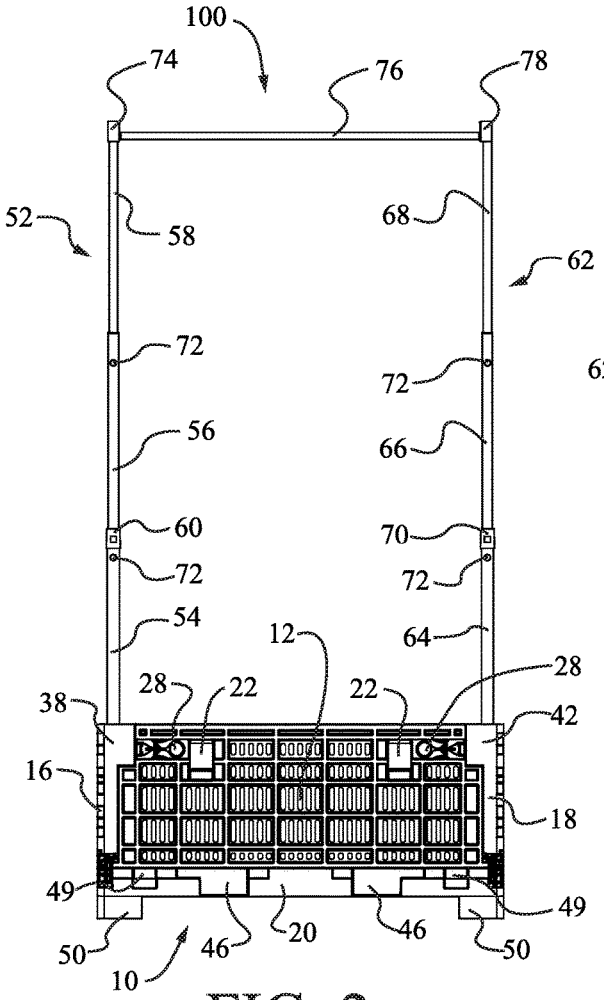
FIG. 2 is a first side view of the clothing container and rack of FIG. 1.
Figure 3:
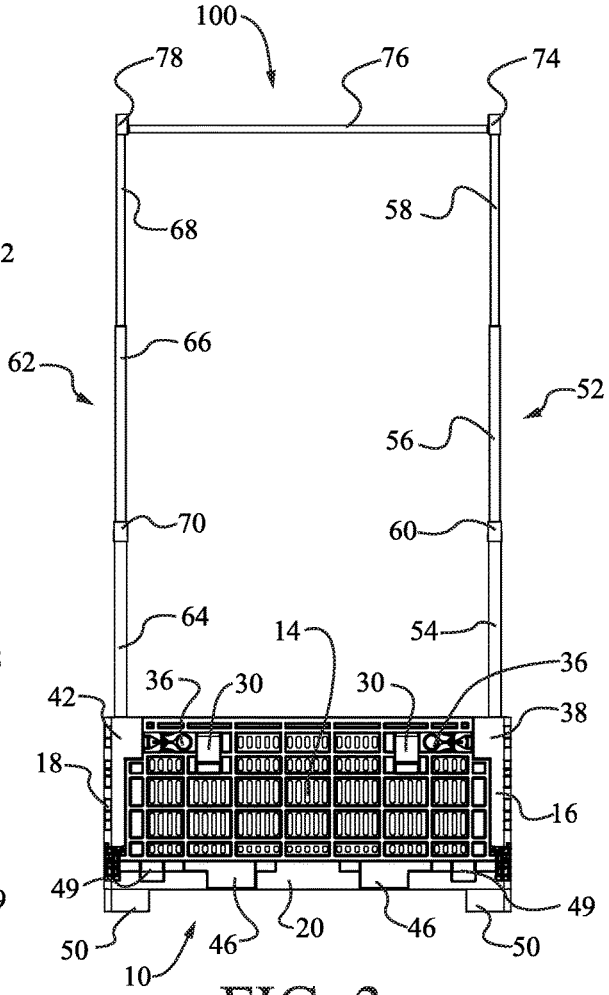
FIG. 3 is a second side view of the clothing container and rack of FIG. 1.
Figure 4:
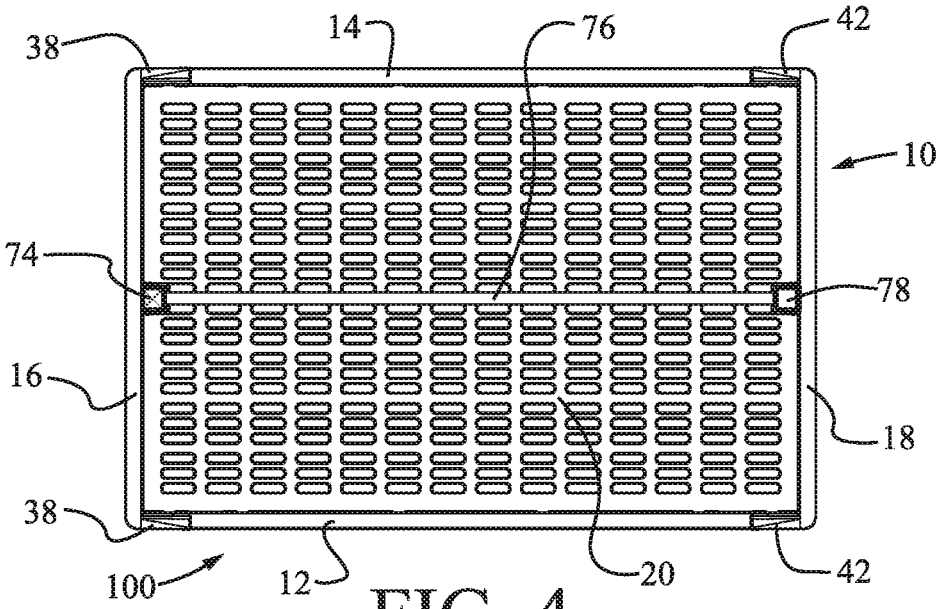
FIG. 4 is a top plan view of the clothing container and rack of FIG. 1.
Figure 5:
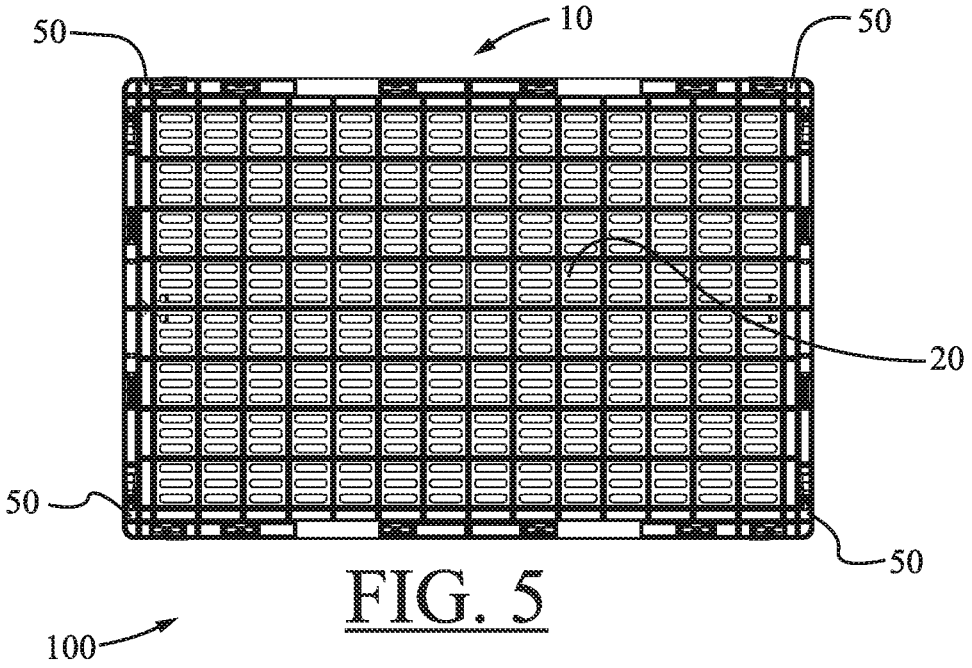
FIG. 5 is a bottom plan view of the clothing container and rack of FIG. 1.
Figure 6:
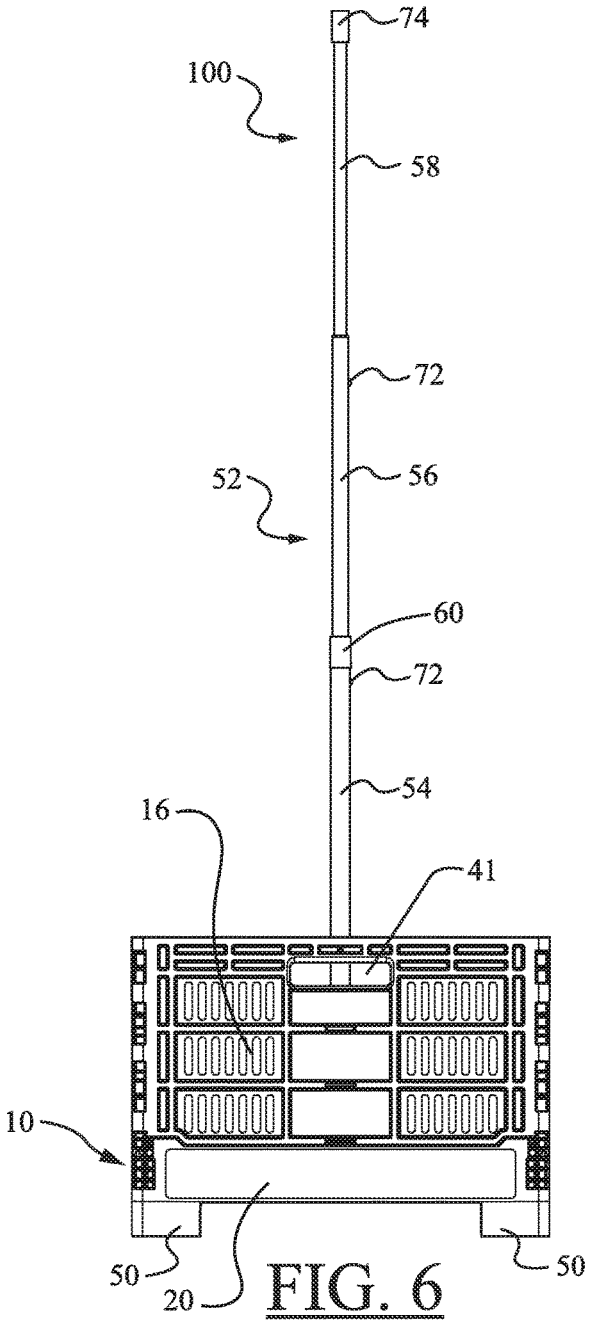
FIG. 6 is a first end elevational view of the clothing container and rack of FIG. 1.
Figure 7:
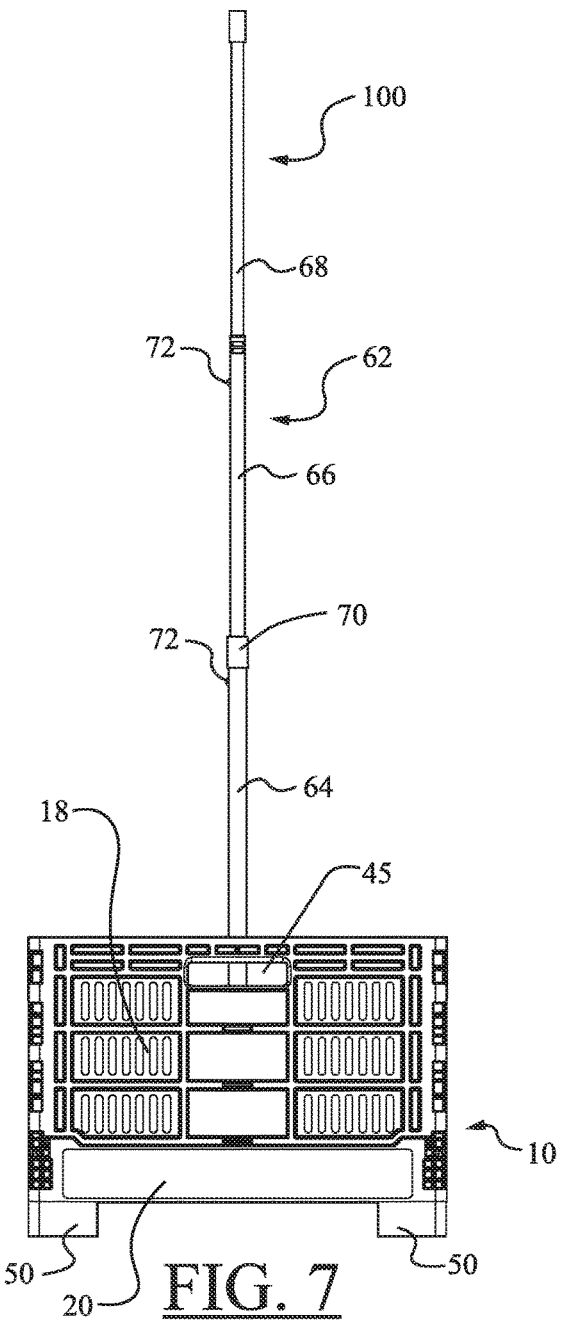
FIG. 7 is a second end elevational view of the clothing container and rack of FIG. 1.

An illustrative embodiment of a clothing container and rack is seen generally at 100 in FIGS. 1-7. With initial reference to the perspective view of FIG. 1, it can be seen that the clothing container and rack 100 generally comprises a collapsible crate 10 having a plurality of collapsible side panels 12, 14, 16, 18 pivotably coupled to a bottom portion 20, the collapsible crate 10 defining an interior cavity for holding one or more items of apparel; and a clothing rack 52, 62, 76 configured to be attached to the collapsible crate 10, the clothing rack 52, 62, 76 including a clothes rod 76 for hanging one or more items of clothing 86 (see FIG. 16). In the illustrative embodiment, as shown in FIG. 1, the collapsible crate 10 comprises a first pair of collapsible side panels 12, 14 and a second pair of collapsible side panels 16, 18 (i.e., collapsible end panels 16, 18). The collapsible side panels 12, 14 fold first in the illustrative embodiment, and the collapsible end panels 16, 18 fold last in the illustrative embodiment. In the illustrative embodiment, the collapsible side panels 12, 14 and the collapsible end panels 16, 18 are each pivotally coupled to the bottom portion 20 of the crate 10 via respective hinge portions integrally formed with the bottom 20 and sides 12, 14, 16, 18 of the crate 10. For example, as shown in FIG. 17, the collapsible side panels 12, 14 are provided with hinge portions 26, 34 that pivotally engage with corresponding hinge recesses 48 on the bottom 20 of the crate 10.

As shown in FIGS. 1, 2, 3, 6, and 7, in the illustrative embodiment, a foot member 50 is provided in each of the four (4) corners of the collapsible crate 10 so as to elevate the bottom portion 20 of the crate 10 above the support surface on which the crate 10 is placed (e.g., a floor of a room). That way, the bottom portion 20 of the crate 10 can be elevated above the ground to prevent the bottom 20 of the crate 10 from being in direct contact with the ground, which is particularly beneficial if the ground is wet, dirty, etc.

Figure 8:
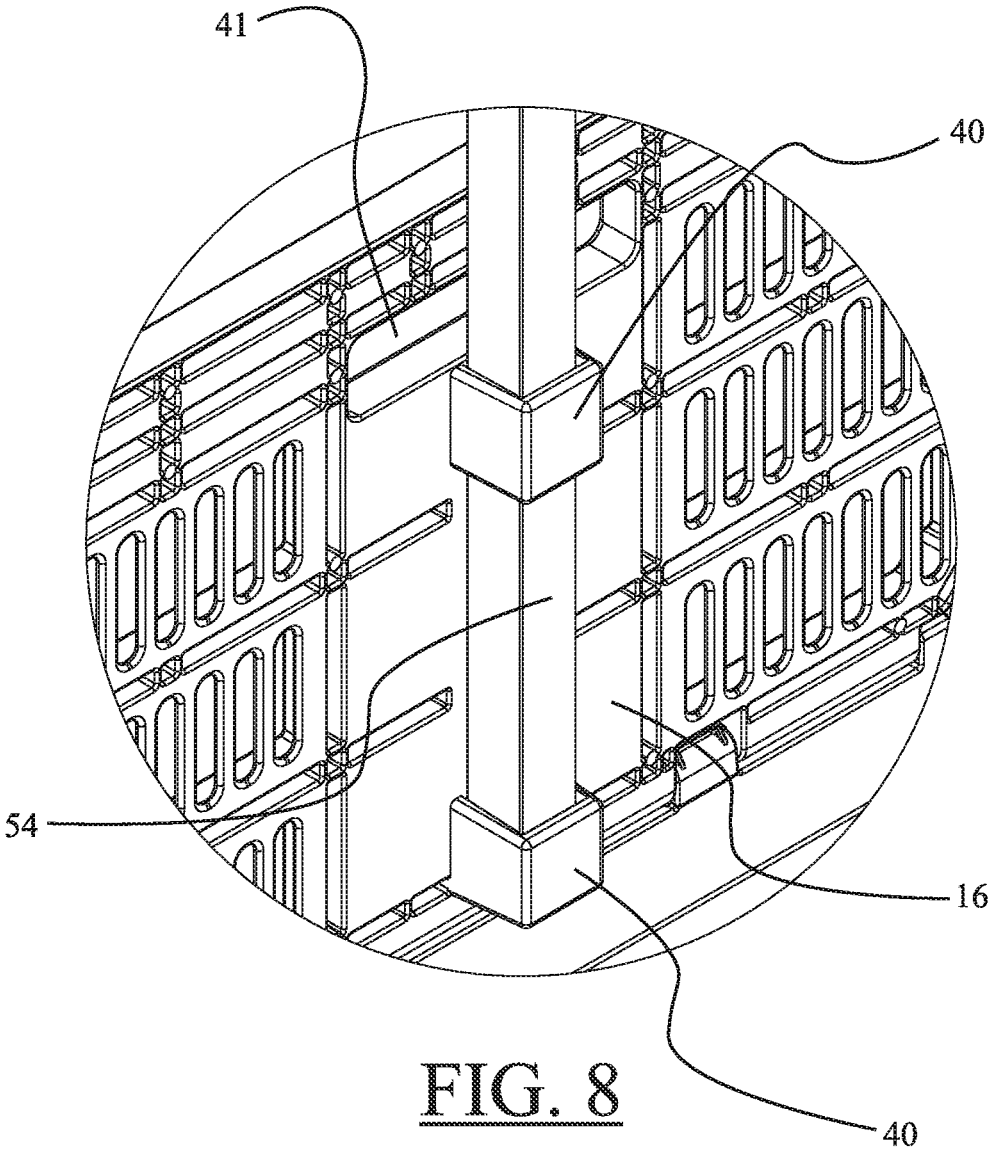
FIG. 8 is an enlarged perspective view illustrating one pair of the post brackets of the clothing container and rack of FIG. 1.
Figure 9:
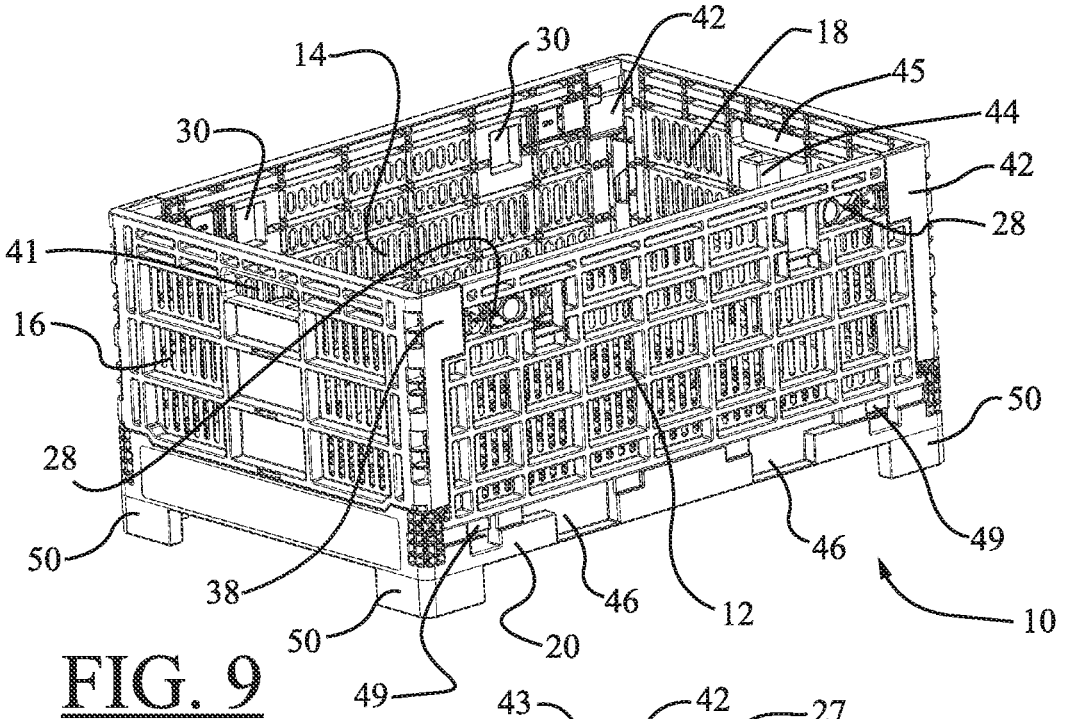
FIG. 9 is a perspective view illustrating the collapsible crate of the clothing container and rack of FIG. 1, wherein the collapsible crate is illustrated in a fully unfolded operative state.
Figure 10:
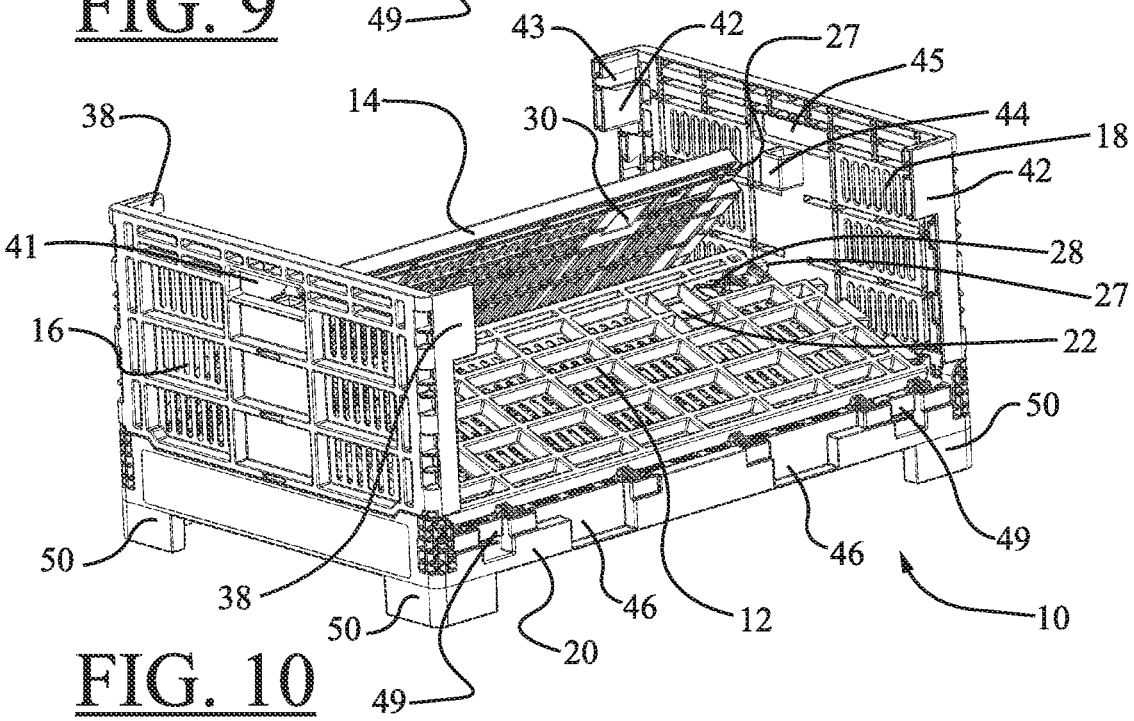
FIG. 10 is another perspective view illustrating the collapsible crate of the clothing container and rack of FIG. 1, wherein the sides of the collapsible crate are shown being folded.
Figure 11:
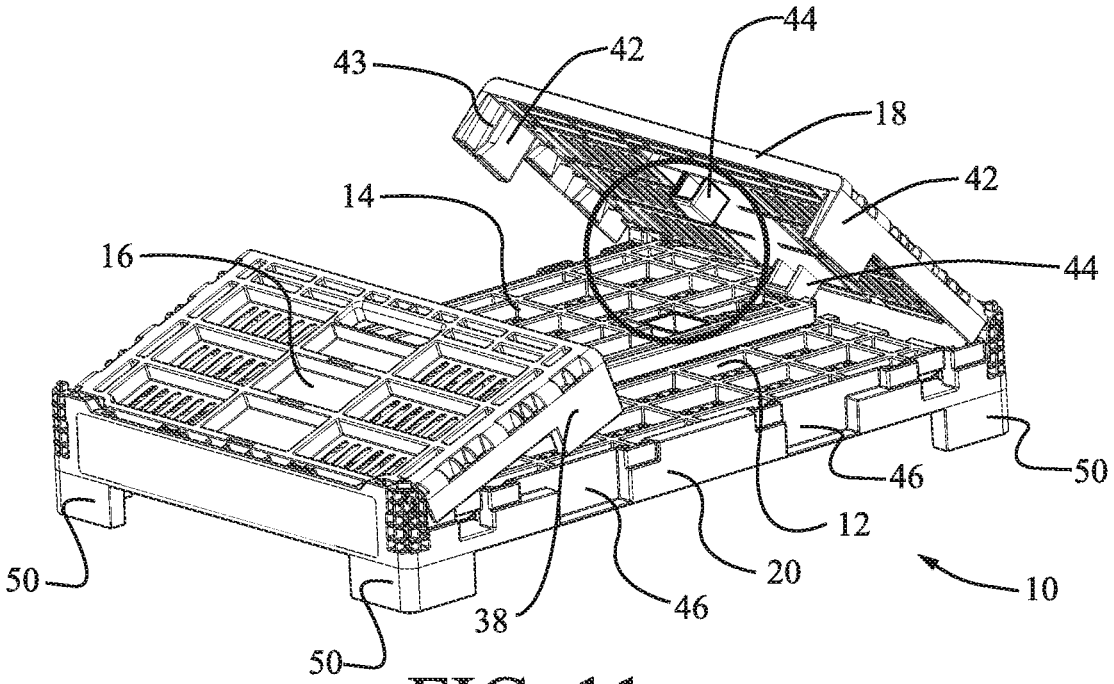
FIG. 11 is yet another perspective view illustrating the collapsible crate of the clothing container and rack of FIG. 1, wherein the ends of the collapsible crate are shown being folded.
Figure 17:
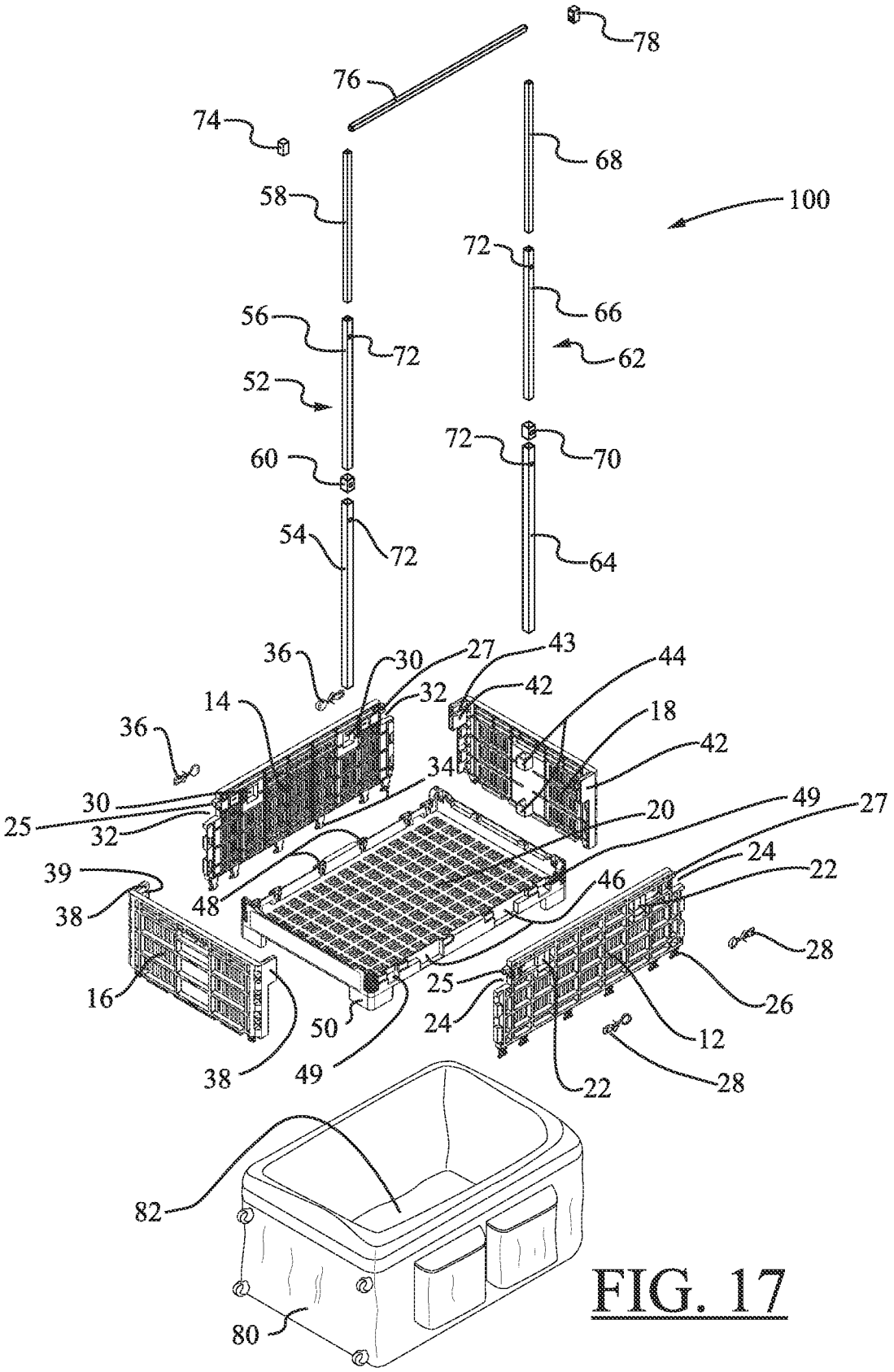
FIG. 17 is an exploded perspective view of the clothing container and rack of FIG. 16.

In the illustrative embodiment, referring to FIGS. 1, 8, and 17, it can be seen that the first collapsible end panel 16 comprises a pair of post bracket members 40 for receiving a first vertical support post 52 of the clothing rack, and the second collapsible end panel 18 comprises a pair of post bracket members 44 for receiving a second vertical support post 62 of the clothing rack. More specifically, as shown in FIG. 11, each post bracket member 40, 44 defines a respective post receiving aperture for receiving a portion of the first vertical support post 52 or the second vertical support post 62. Also, in the illustrative embodiment, as shown in FIGS. 1, 9, 10, 11, and 13, the first collapsible side panel 12 comprises a pair of bracket apertures 22 disposed therethrough for accommodating the upper post bracket members 40, 44 when the collapsible end panels 16, 18 are folded onto the collapsible side panels 12, 14. Similarly, the second collapsible side panel 14 comprises a pair of bracket apertures 30 disposed therethrough for accommodating the upper post bracket members 40, 44 when the collapsible end panels 16, 18 are folded onto the collapsible side panels 12, 14 (see FIGS. 10, 11, and 13).

As best shown in the exploded view of FIG. 17, in the illustrative embodiment, the first collapsible side panel 12 comprises end notches 24 formed in opposite top corners of the collapsible side panel 12, and the second collapsible side panel 14 comprises similar end notches 32 formed in opposite top corners of the collapsible side panel 14. The end notches 24, 32 in the top corners of the collapsible side panels 12, 14 are configured to allow the collapsible side panels 12, 14 to be folded onto the bottom portion 20 of the crate 10 without being obstructed by the bracket members 40, 44 of the collapsible end panels 16, 18 (see FIG. 10).

In the illustrative embodiment, the post bracket members 40, 44 are integrally formed with the respective collapsible end panels 16, 18 (e.g., by injection molding). Advantageously, integrally forming the post bracket members 40, 44 with the respective collapsible end panels 16, 18 obviates the need for the tedious alignment of separate bracket components. The integrally formed post bracket members 40 on the first end panel 16 of the collapsible crate 10 are nearly perfectly aligned with the integrally formed post bracket members 44 on the second end panel 18 (e.g., in both height and angle) so that the clothing rack 52, 62, 76 is straight and centered in the deployed state of the clothing container and rack 100. As such, the assembly defects associated with the use of separate bracket components are avoided.

With combined reference to the illustrative embodiment of FIGS. 9-12 and 17, it can be seen that the first collapsible end panel 16 comprises upper protrusions 38 (e.g., in the form of protruding tabs 38) disposed in opposite top corners of the end panel 16, and the second collapsible end panel 18 comprises upper protrusions 42 (e.g., in the form of protruding tabs 42) disposed in opposite top corners of the end panel 18. Each of the protrusions 38 comprises a respective recess 39 on an interior surface thereof (see e.g., FIG. 17) that receives a respective projection 25 on the side panels 12, 14 when the side panels 12, 14 are connected to the end panels 16, 18. Similarly, each of the protrusions 42 comprises a respective recess 43 on an interior surface thereof (see e.g., FIG. 17) that receives a respective projection 27 on the side panels 12, 14 when the side panels 12, 14 are connected to the end panels 16, 18. Also, referring again to FIGS. 9-12 and 17, it can be seen that the bottom portion 20 of the collapsible crate 10 comprises recesses 46 for accommodating the upper protrusions 38, 42 of the collapsible end panels 16, 18 when the collapsible end panels 16, 18 are folded onto the bottom portion 20 of the collapsible crate 10 (see FIG. 12). When folding the end panels 16, 18, the shapes of the upper protrusions 38, 42 are designed to fit into specially molded recesses 46 in the bottom of the crate 10, and thus create a "stop" for the end panels 16, 18 so that the end panels 16, 18 are not able to fold downward any further than approximately 90 degrees. Without the recesses 46, the end panels 16, 18 would create a "crushing" effect on the side panels 12, 14 of the crate 10 and could break the bracket members 40, 44.

As shown in FIGS. 1, 14, 15, and 17, in the illustrative embodiment, the first collapsible side panel 12 of the collapsible crate 10 is provided with a pair of locking members 28, and the second collapsible side panel 14 of the collapsible crate 10 is provided with a pair of locking members 36. As will be explained in further detail hereinafter, the locking members 28, 36 are used to lock the collapsible side panels 12, 14 in place relative to the collapsible end panels 16, 18 when the collapsible crate 10 is in its deployed position of FIGS. 1 and 9. In the detail view depicted in FIG. 14, the locking member 28 is disposed in its locked position where the collapsible side panel 12 is secured to the collapsible end panel 18. In the detail view depicted in FIG. 15, the locking member 28 is disposed in its unlocked position where the collapsible side panel 12 is able to be detached from the collapsible end panel 18.

Turning to FIGS. 1 and 6-9 of the illustrative embodiment, it can be seen that the first collapsible end panel 16 is provided with a first handle aperture 41 formed therein, and the second collapsible end panel 18 is provided with a second handle aperture 45 formed therein. The handle apertures 41, 45 facilitate the carrying of the collapsible crate 10 by a user when the crate 10 is in its deployed position of FIGS. 1 and 9.

Now, referring to FIGS. 1 and 17, the clothing rack 52, 62, 76 of the clothing container and rack 100 will be described in further detail. In the illustrative embodiment, the first and second vertical support posts 52, 62 are each in the form of a telescoping support post with a plurality of telescoping sections. More specifically, the first vertical support post 52 comprises a bottom post section 54, a first telescoping section 56 received within the bottom post section 54, and a second telescoping section 58 received within the first telescoping section 56. Similarly, the second vertical support post 62 comprises a bottom post section 64, a first telescoping section 66 received within the bottom post section 64, and a second telescoping section 68 received within the first telescoping section 66. Also, as shown in FIGS. 1 and 17, the first vertical support post 52 may comprise an outer sleeve member 60 where the first telescoping section 56 emerges from the bottom post section 54, and the second vertical support post 62 may comprise an outer sleeve member 70 where the first telescoping section 66 emerges from the bottom post section 64. In the illustrative embodiment, to maintain the telescoping sections 56, 58, 66, 68 in their extended positions (i.e., as shown in FIG. 1), each of the telescoping sections 56, 58, 66, 68 is locked in place using a push button locking device 72.

As shown in the illustrative embodiment of FIGS. 1 and 17, the horizontal clothes rod 76 of the clothing rack 52, 62, 76 is supported between the first and second vertical support posts 52, 62. More specifically, as shown in these figures, the second telescoping section 58 of the first vertical support post 52 is provided with a first end cap 74 that receives a first end of the horizontal clothes rod 76, and the second telescoping section 68 of the second vertical support post 62 is provided with a second end cap 78 that receives a second end of the horizontal clothes rod 76.

Figure 12:
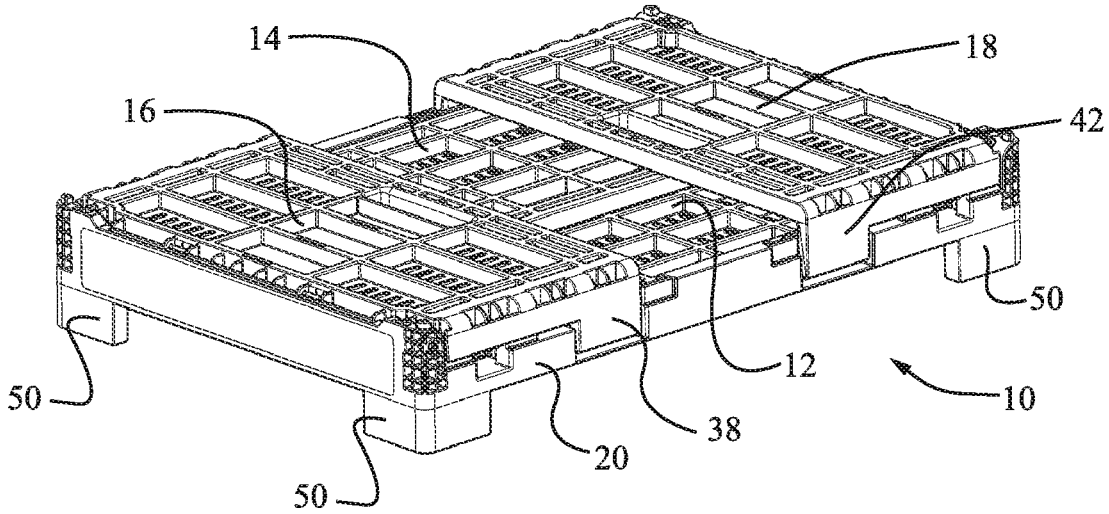
FIG. 12 is still another perspective view illustrating the collapsible crate of the clothing container and rack of FIG. 1, wherein the collapsible crate is illustrated in a fully collapsed state.
Figure 13:
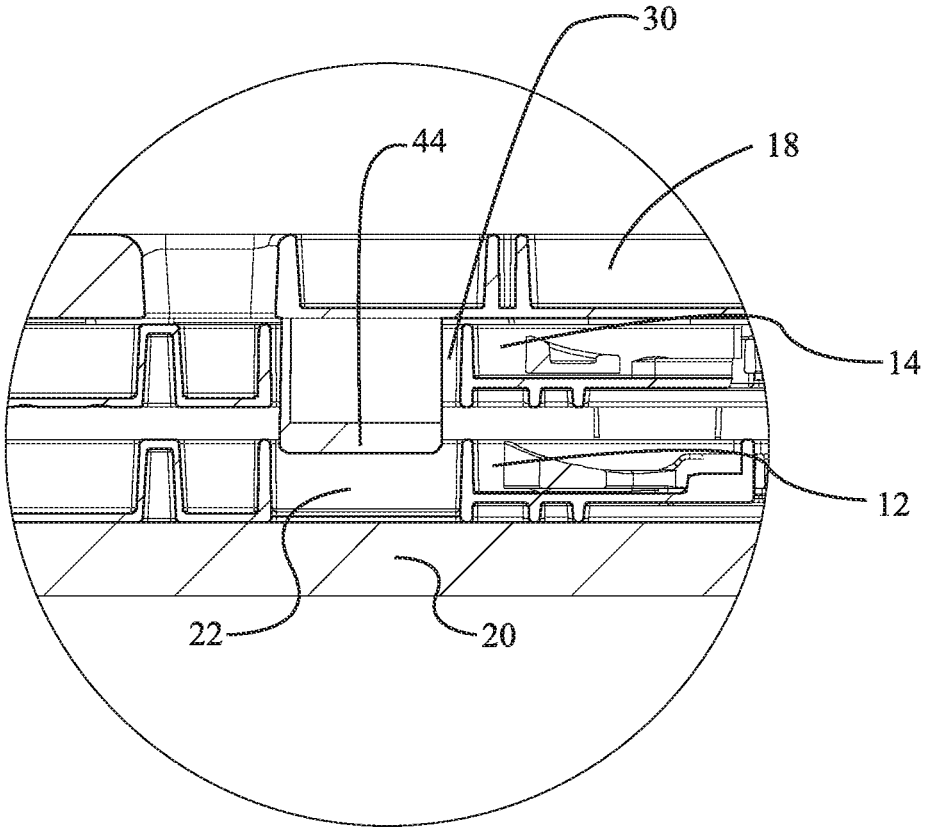
FIG. 13 is an enlarged sectional view illustrating one of the post brackets on one end of the collapsible crate of the clothing container and rack of FIG. 1 being received within the bracket apertures in the sides of the collapsible crate (Detail "A")
Figure 14:
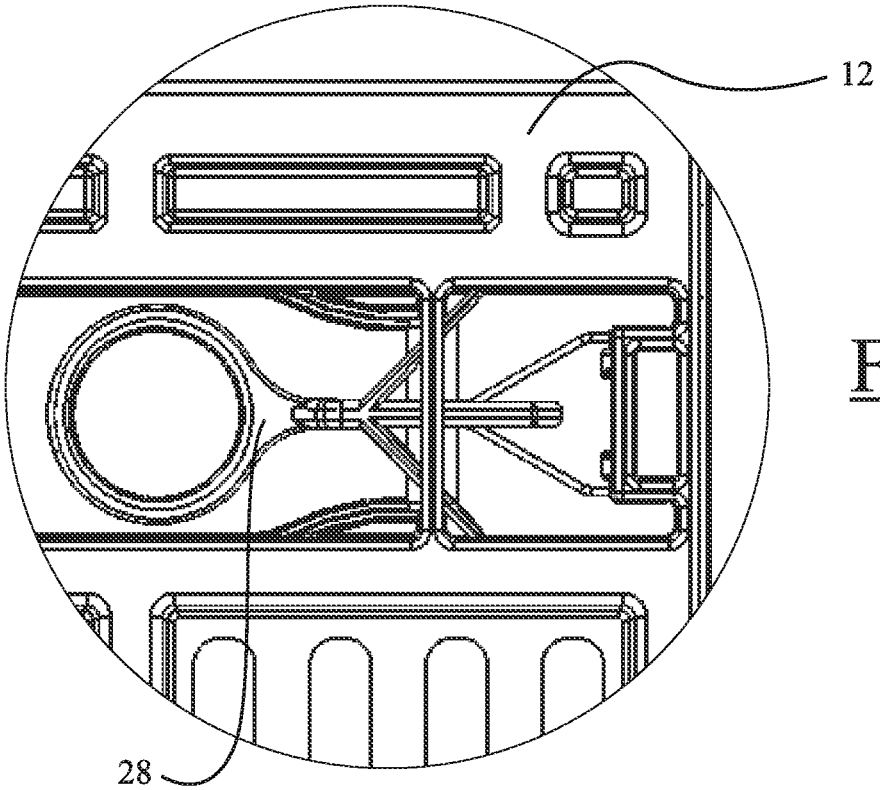
FIG. 14 is an enlarged partial side view of the collapsible crate of the clothing container and rack of FIG. 1 illustrating one of the crate locking members, wherein the crate locking member is depicted in a locked position.
Figure 15:
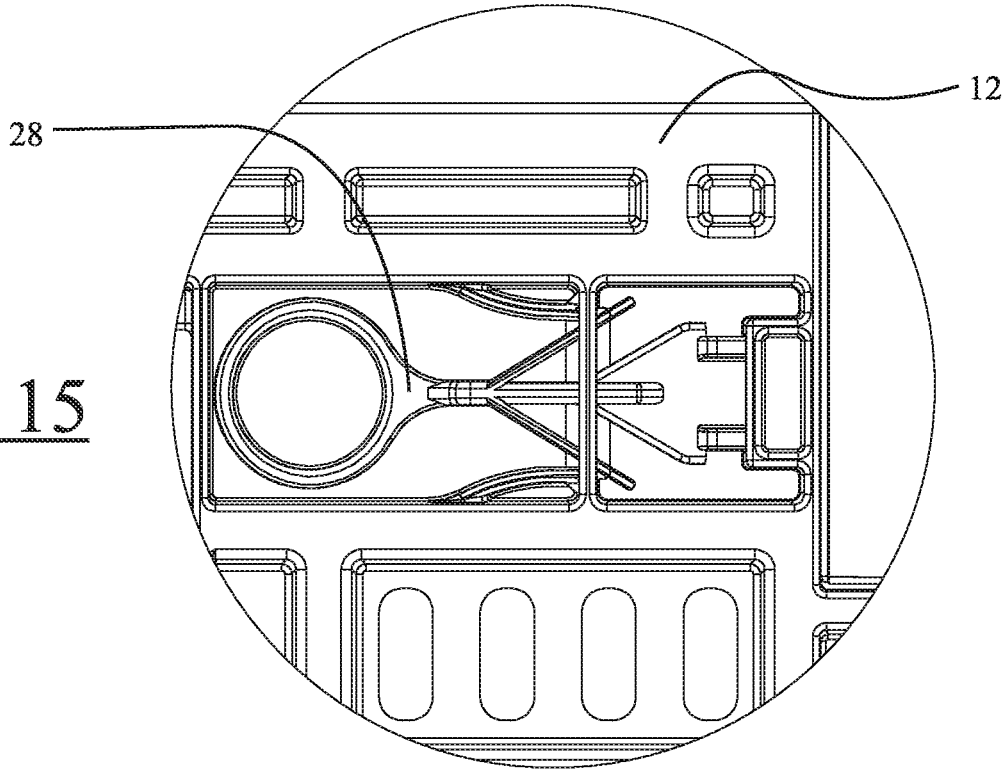
FIG. 15 is another enlarged partial side view of the collapsible crate similar to FIG. 14, except that the crate locking member is depicted in an unlocked position.

Next, referring to FIGS. 9-12, the manner in which the collapsible crate 10 is collapsed by a user will be explained in detail. In FIG. 9, the collapsible crate 10 is depicted in its deployed position. Then, to disengage the collapsible side panels 12, 14 from the collapsible end panels 16, 18, a user pulls the locking members 28, 36 inwardly towards the middle of the crate 10 by placing his or her fingers in the finger apertures of the locking members 28, 36 and applying an axial force on the locking members 28, 36. After the locking members 28, 36 are disengaged, then the side panels 12, 14 of the crate 10 are able to be folded onto the bottom portion 20 of the crate 10 as depicted in FIG. 10. As the side panels 12, 14 are being folded down onto the bottom portion 20 of the crate 10, the end notches 24, 32 in the top corners of the side panels 12, 14 prevent the side panels 12, 14 from being obstructed by the post bracket members 40, 44. After the collapsible side panels 12, 14 of the crate 10 have been folded onto the bottom portion 20 of the crate 10, the collapsible end panels 16, 18 are then folded down onto the side panels 12, 14 as depicted in FIG. 11. As the end panels 16, 18 are being folded down onto the side panels 12, 14, the bracket apertures 22, 30 in the side panels 12, 14 of the crate 10 allow the end panels 16, 18 to be fully collapsed onto the side panels 12, 14 because the post bracket members 40, 44 are received within the bracket apertures 22, 30 in the collapsed state of the crate 10 (see e.g., FIG. 13). The bracket apertures 22, 30 are particularly positioned so that the post bracket members 40, 44 of the end panels 16, 18 are accommodated in a collapsed state of the crate 10 (i.e., the apertures 22, 30 and the post bracket members 40, 44 have a male and female relationship, ultimately giving the brackets 40, 44 a place to be stored which helps the crate 10 to fold as flat as possible to save space). In FIG. 12, the collapsible crate 10 is depicted in its fully collapsed position.

In order to transform the collapsible crate 10 from its fully collapsed position of FIG. 12 to its deployed position of FIG. 9, the steps depicted in FIGS. 9-12 are performed in reverse order. That is, the end panels 16, 18 are initially rotated into their upright positions (i.e., the FIG. 10 position of the end panels 16, 18). Then, the side panels 12, 14 are rotated into their upright positions until the side panels 12, 14 engage with the end panels 16, 18. Finally, the side panels 12, 14 are locked in placed relative to the end panels 16, 18 by means of the locking members 28, 36.

Figure 21:
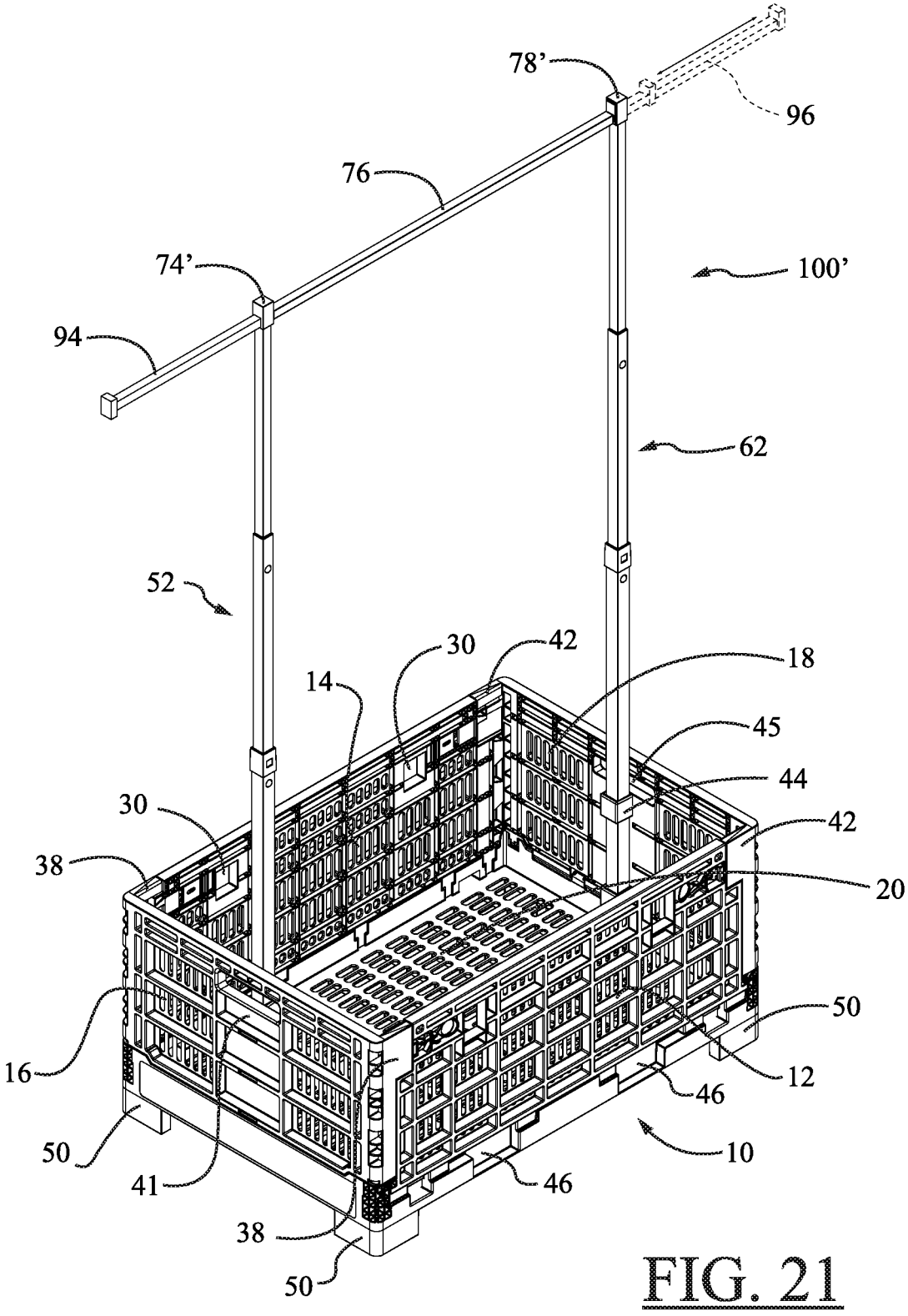
FIG. 21 is a perspective view of a clothing container and rack similar to that of FIG. 1, except that the clothes rod of the clothing rack is provided with rod extensions on the opposed ends thereof.

Now, with reference to FIG. 21, an alternative embodiment of a clothing container and rack 100' will be described. The clothing container and rack 100' of FIG. 21 is similar in all respects to the clothing container and rack 100 of FIG. 1, except that the horizontal clothes rod 76 is provided with first and second rod extensions 94, 96 that are configured to be extended beyond respective ones of the first and second vertical support posts 52, 62. More specifically, as shown in FIG. 21, the first rod extension 94 extends outwardly from the first end cap 74' of the first vertical support post 52 in a cantilevered manner so as to provide additional rod space on the outer side of the first vertical support post 52. Similarly, referring again to FIG. 21, the second rod extension 96 extends outwardly from the second end cap 78' of the second vertical support post 62 in a cantilevered manner so as to provide additional rod space on the outer side of the first vertical support post 62. Advantageously, the first and second rod extensions 94, 96 enable more clothes to be hung on the clothing rack 52, 62, 76 of the clothing container and rack 100'.

Figure 19:
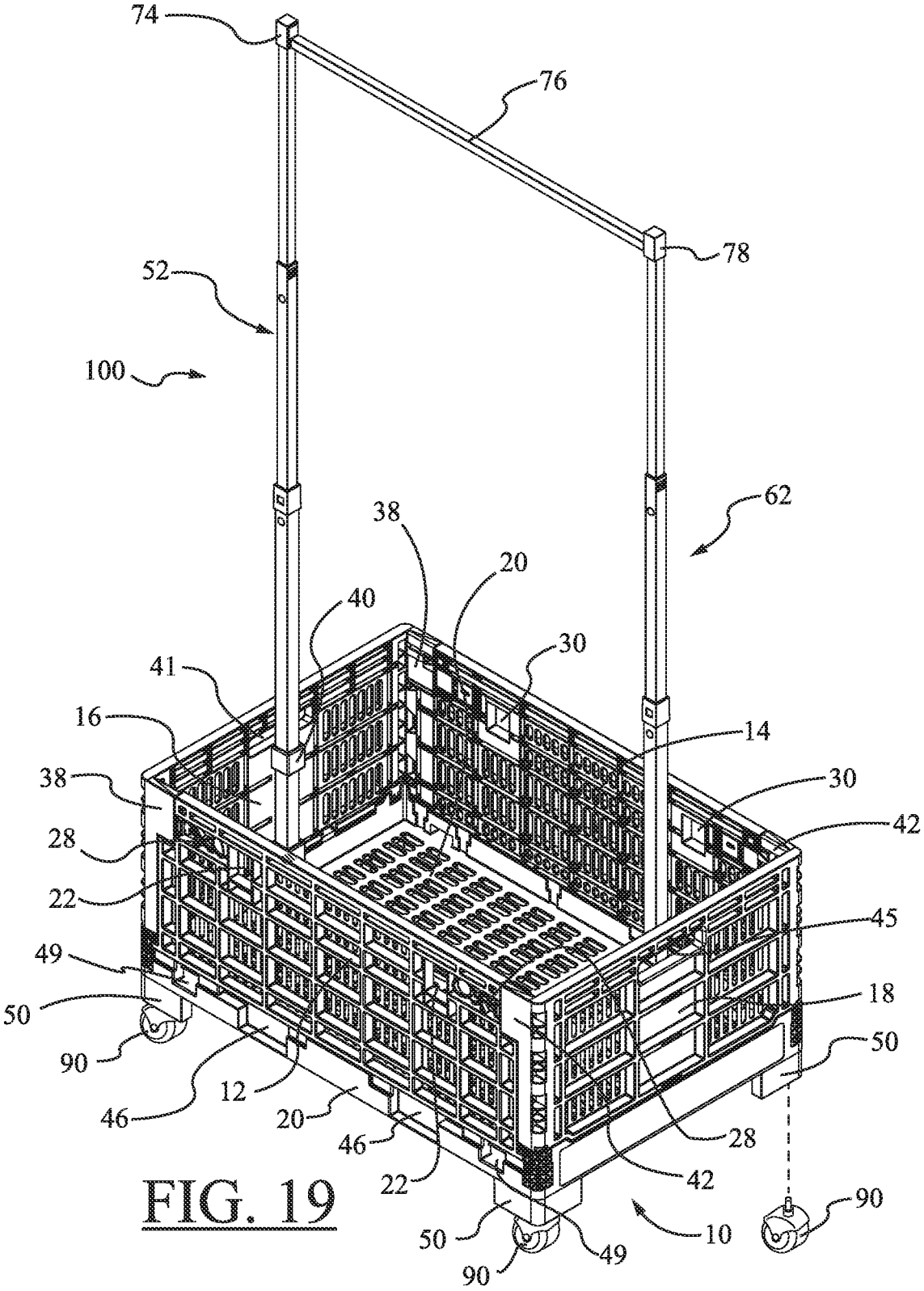
FIG. 19 is another perspective view of the clothing container and rack of FIG. 1, wherein the feet of the collapsible crate are shown being provided with wheels.

Turning to FIG. 19, it can be seen that, in the illustrative embodiment, the bottom portion 20 of the collapsible crate 10 of the clothing container and rack 100 may comprise a plurality of wheels or casters 90 that allow the clothing container and rack 100 to be more easily transported. More specifically, as shown in FIG. 19, each foot member 50 is configured to receive a respective wheel or caster 90 such that wheels 90 are provided in each of the four (4) corners of the crate 10.

Figure 20:
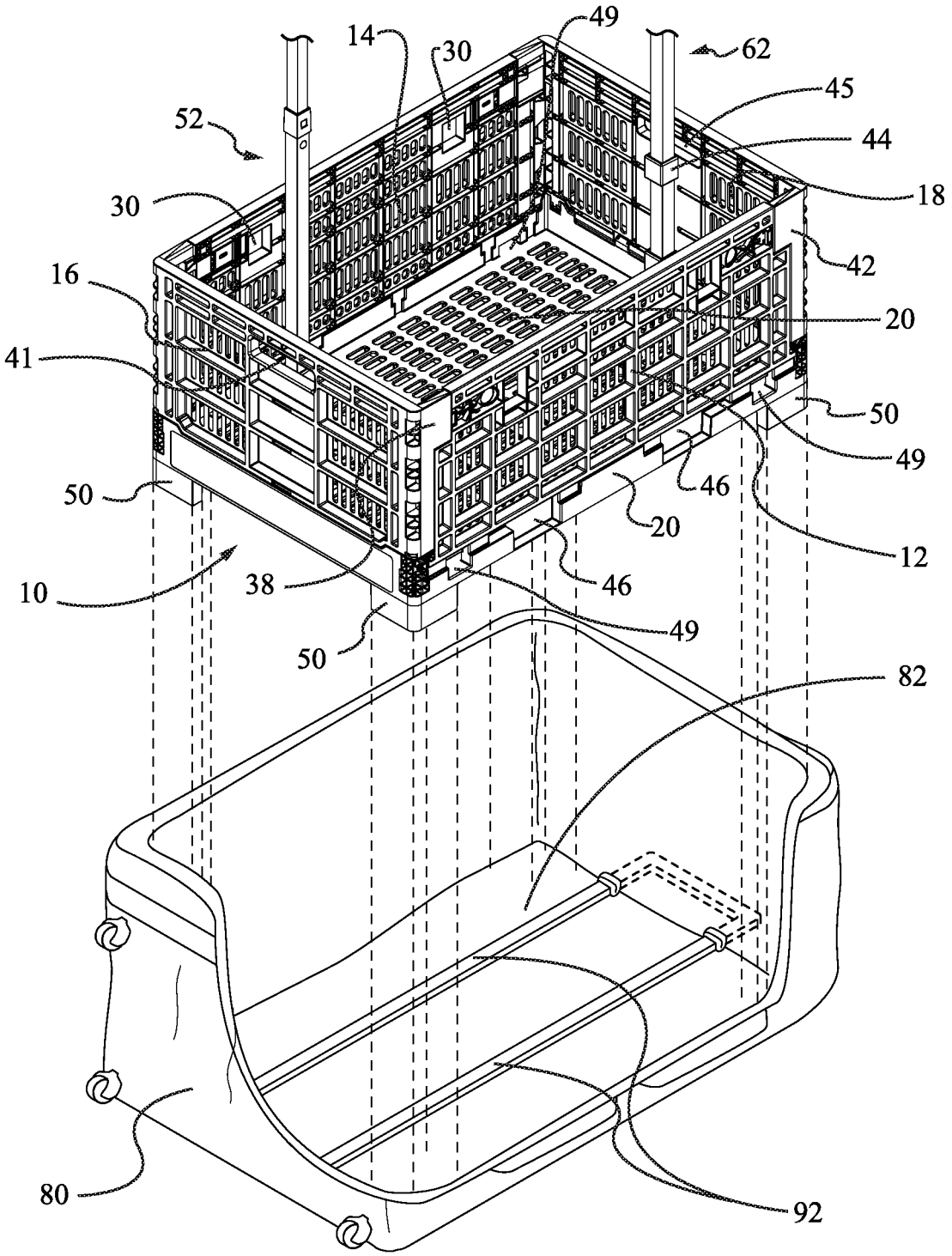
FIG. 20 is a partially exploded perspective view of the clothing container and rack of FIG. 16, wherein the collapsible crate is shown exploded from the piece of luggage to illustrate how the feet operate as spacers.

Next, referring to FIGS. 16, 17, 18, 20, and 22, a further aspect of the illustrative embodiment will be described. As shown in these figures, the clothing container and rack 100 may further comprise a suitcase housing 80 disposed around the collapsible crate 10. In accordance with this further aspect of the illustrative embodiment, the collapsible crate 10 forms the suitcase frame supporting the suitcase housing 80 such that no additional frame is required in the suitcase (i.e., the collapsible crate 10 forms the frame of the roller suitcase depicted in FIG. 16). In FIG. 20, it can be seen that the collapsible crate 10 is received within the interior 82 of the suitcase housing 80 so as to form the frame of the suitcase. Also, as shown in FIG. 20, the foot members 50 of the collapsible crate 10 are configured to operate as spacers for accommodating a retractable handle structure 92 of the suitcase housing 80. In a typical suitcase, the frame of the retractable handle is riveted to the interior bottom of the luggage piece. The foot members 50 allow the crate 10 to fit inside a piece of luggage and stand above the retractable frame making it stable so that it does not "teeter" on top of the frame and shift around in the bag. In other embodiments, the collapsible crate 10 may also form the frame of a rolling duffel bag.

Figure 22:
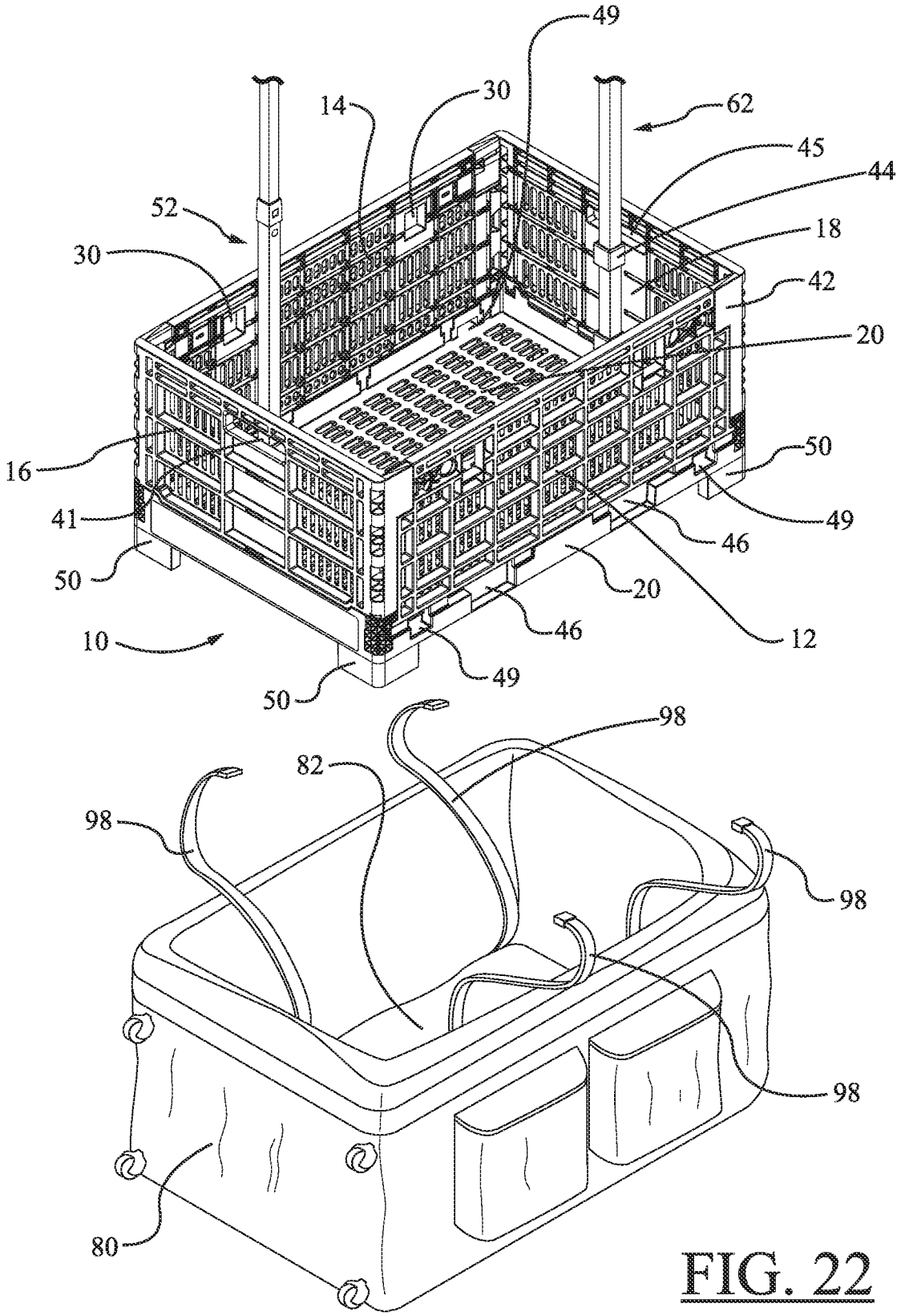
FIG. 22 is a partially exploded perspective view of the clothing container and rack of FIG. 16, wherein the collapsible crate is shown exploded from the piece of luggage to illustrate the luggage attachment straps.

In the illustrative embodiment of FIGS. 20 and 22, it can be seen that the bottom portion 20 of the collapsible crate 10 comprises a plurality of apertures 49 disposed in the bottom portion 20 of the crate 10. The plurality of apertures 49 in the bottom portion 20 of the crate 10 are configured to accommodate suitcase straps 98 for securing the collapsible crate 10 to the suitcase housing 80 (see FIG. 22). In the illustrative embodiment, each of the apertures 49 is located near a respective corner of the bottom portion 20 of the crate 10.

In one or more alternative embodiments, straps 98 are not required for securing the collapsible crate 10 to the suitcase housing 80.

Figure 16:
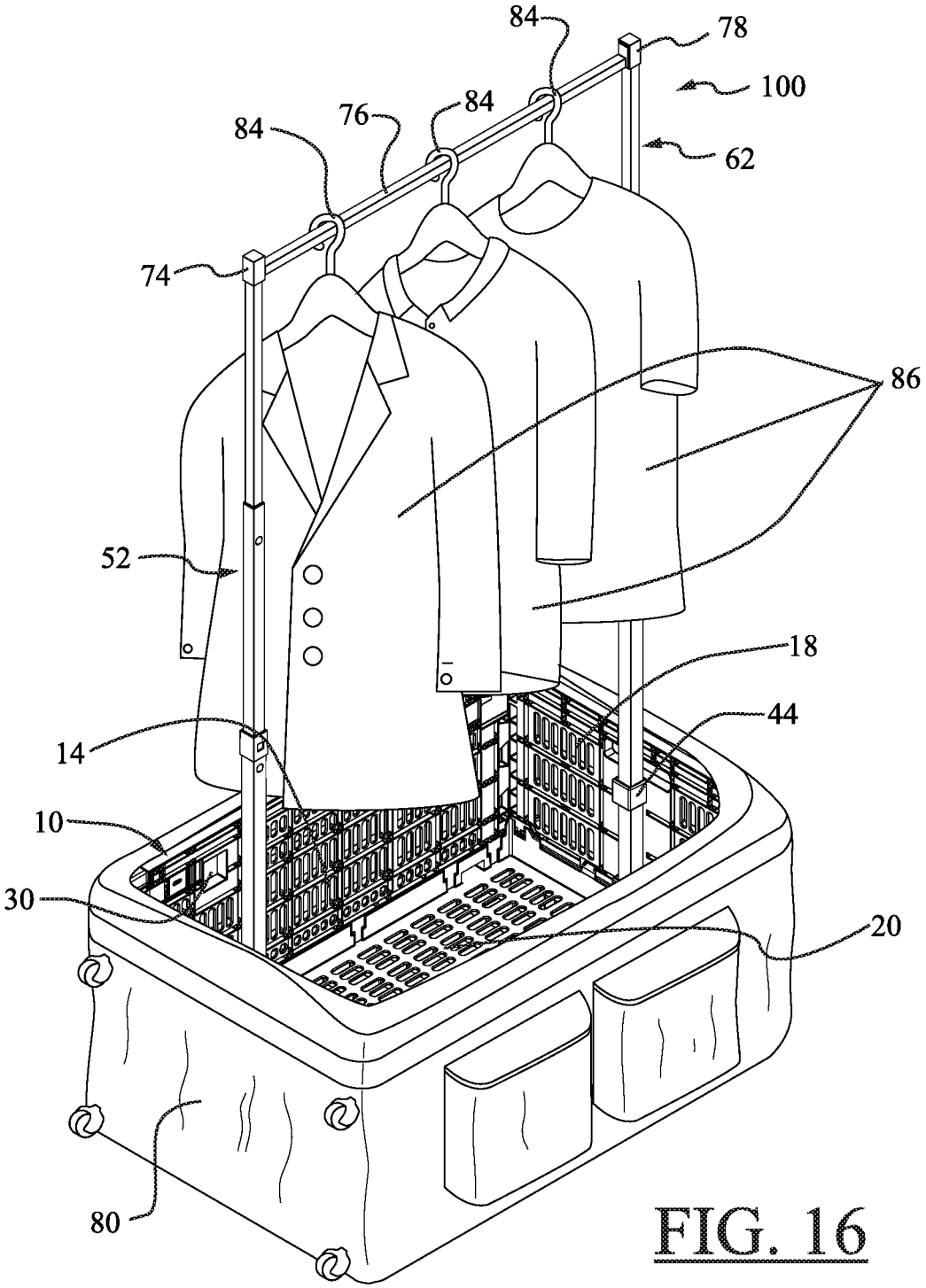
FIG. 16 is a perspective view of a clothing container and rack, according to a further aspect of the illustrative embodiment of the invention, wherein the collapsible crate of the clothing container and rack forms a frame of a piece of luggage.
Figure 18:
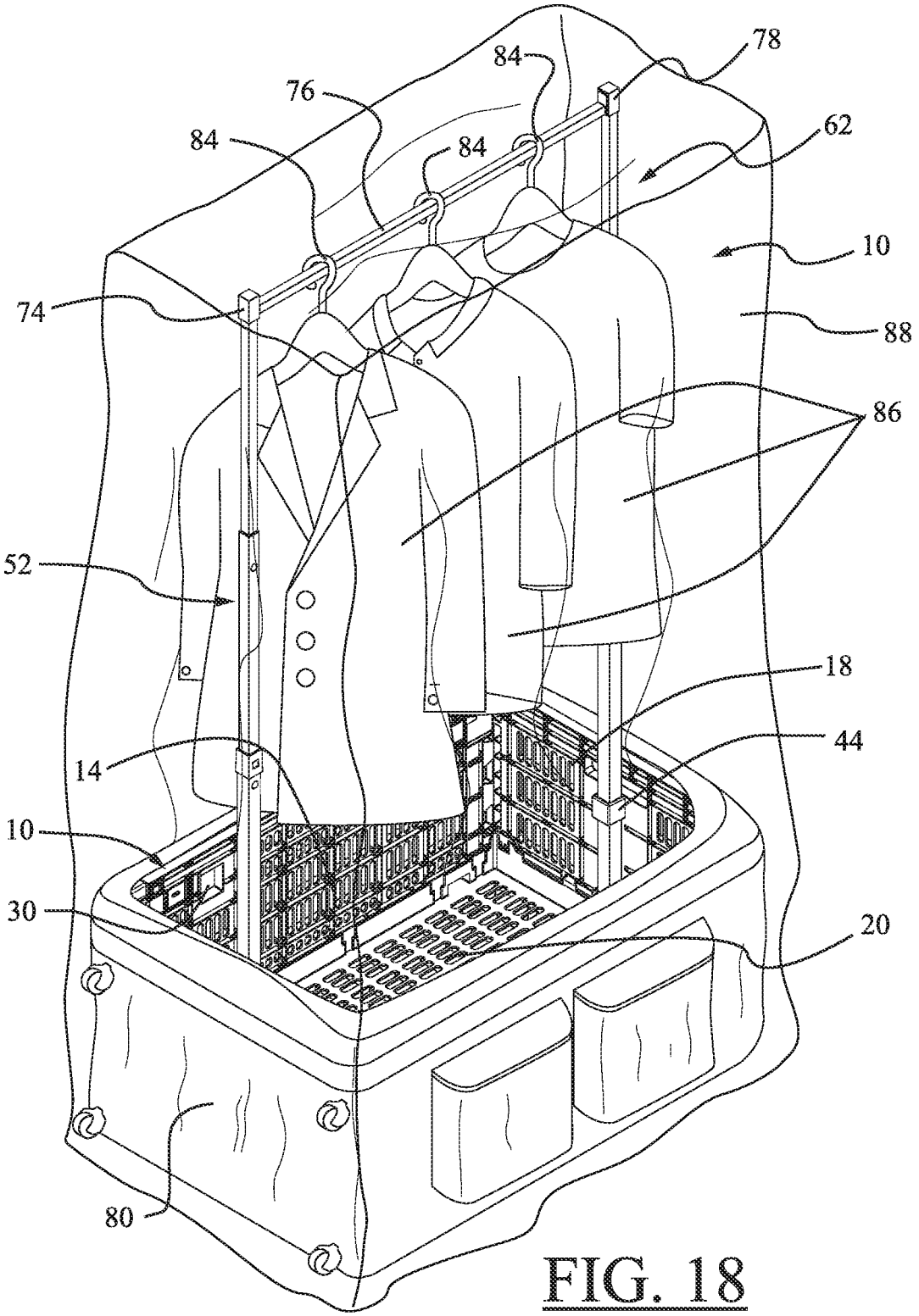
FIG. 18 is another perspective view of the clothing container and rack of FIG. 16, wherein a plastic cover is shown disposed over the garments on the clothing rack.

Referring now to FIGS. 16 and 18 of the illustrative embodiment, it can be seen that the clothing container and rack 100 can advantageously operate as a collapsible closet system where items of clothing 86 are able to be hung from the clothes rod 76 using hangers 84 when the clothing container and rack 100 is in its deployed state. Also, as shown in FIG. 18, in the deployed state, a clear plastic cover 88 may be placed over the items of clothing 86 to protect the items of clothing 86 from being damaged or accumulating dust or dirt thereon. When it is time to transport the clothes 86 to another location, the clothing rack 52, 62, 76 is able to be collapsed into the crate 10 and the clothing is able to be stowed in the suitcase 80 for transportation.

It is readily apparent that the aforedescribed clothing container and rack 100, 100' offers numerous advantages. First, clothing container and rack 100, 100' utilizes a collapsible crate 10 that can be easily converted into a garment rack. For example, the clothing container and rack 100, 100' may serve as a laundry basket with a garment rack for use by college students, people in tiny houses or apartments with little closet space, or people who own recreational vehicles (RVs) that need a mobile laundry system or additional garment rack storage. The clothing container and rack 100, 100' may also be used for drying wet clothes, or as an additional garment rack for basements. The interior of the crate 10 of the clothing container and rack 100, 100' may be used for general additional storage, such as for the storage of shoes, hats, gloves, etc. Secondly, the clothing container and rack 100, 100' folds into a relatively thin structure for compact storage (see e.g., FIG. 12). Also, when the clothing container and rack 100, 100' is in its collapsed state, it produces a very strong structure for storage. Finally, the clothing container and rack 100, 100' is not susceptible to the large number of assembly defects that are experienced in the production of conventional mobile garment racks. Also, because the clothing container and rack 100, 100' uses the collapsible crate 10 as the frame for luggage, the overall size of the luggage is able to be greatly reduced once the collapsible crate 10 acting as the frame is folded. Then, the luggage becomes much thinner for storage so that it can be stowed in a much smaller space (e.g., under a bed, etc.).

When the clothing container and rack 100, 100' is used as a laundry basket, it has the unique feature of having a clothes garment rack that can be easily set up and quickly disassembled. Also, the clothing container and rack 100, 100' collapses relatively flat for easy storage, such as underneath a bed.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A clothing container and rack, comprising:

a collapsible crate having a plurality of collapsible side panels pivotably coupled to a bottom portion via hinge portions, the collapsible crate defining an interior cavity for holding one or more items of apparel; and a clothing rack configured to be attached to the collapsible crate, the clothing rack including a clothes rod for hanging one or more items of clothing;

wherein at least a first one of the plurality of collapsible side panels of the collapsible crate comprises a bracket member and the clothing rack further comprises at least one support post, the bracket member defining a post aperture for receiving a portion of the at least one support post, and at least a second one of the plurality of collapsible side panels of the collapsible crate comprises a notch formed in a top corner of the collapsible side panel, the notch configured to allow the second one of the plurality of collapsible side panels to be folded onto the bottom portion without being obstructed by the bracket member of the first one of the plurality of collapsible side panels.

2. The clothing container and rack according to claim 1, wherein the second one of the plurality of collapsible side panels of the collapsible crate further comprises an aperture disposed therethrough for accommodating the bracket member of the first one of the plurality of collapsible side panels when the first one of the plurality of collapsible side panels is folded onto the second one of the plurality of collapsible side panels.

3. The clothing container and rack according to claim 1, wherein the bracket member is integrally formed with the first one of the plurality of collapsible side panels.

4. The clothing container and rack according to claim 1, wherein the first one of the plurality of collapsible side panels of the collapsible crate further comprises an upper protrusion and the bottom portion of the collapsible crate comprises a recess for accommodating the upper protrusion of the first one of the plurality of collapsible side panels when the first one of the plurality of collapsible side panels is folded onto the bottom portion of the collapsible crate.

5. The clothing container and rack according to claim 1, further comprising a suitcase housing disposed around the collapsible crate, the collapsible crate forming at least a portion of a suitcase frame supporting the suitcase housing.

6. The clothing container and rack according to claim 5, wherein the bottom portion of the collapsible crate comprises at least one aperture disposed in the bottom portion, the at least one aperture of the bottom portion configured to accommodate a strap for securing the collapsible crate to the suitcase housing.

7. The clothing container and rack according to claim 5, wherein the bottom portion of the collapsible crate comprises a plurality of foot members, the plurality of foot members configured to operate as spacers for accommodating a retractable handle structure of the suitcase housing.

8. The clothing container and rack according to claim 1, wherein the bottom portion of the collapsible crate comprises a plurality of wheels, the plurality of wheels allowing the clothing container and rack to be more easily transported.

9. The clothing container and rack according to claim 1, wherein the at least one support post of the clothing rack further comprises a pair of telescoping support posts, each of the telescoping support posts comprising a plurality of telescoping sections, and the clothes rod being configured to be supported between the telescoping support posts.

10. The clothing container and rack according to claim 9, wherein at least one end of the clothes rod is configured to be extended beyond one of the telescoping support posts.

11. A clothing container and rack, comprising:

a collapsible crate having a plurality of collapsible side panels pivotably coupled to a bottom portion via hinge portions, the collapsible crate defining an interior cavity for holding one or more items of apparel;

a clothing rack configured to be attached to the collapsible crate, the clothing rack including a clothes rod for hanging one or more items of clothing; and a suitcase housing disposed around the collapsible crate, the collapsible crate forming at least a portion of a suitcase frame supporting the suitcase housing;

wherein at least a first one of the plurality of collapsible side panels of the collapsible crate comprises a bracket member and the clothing rack further comprises at least one support post, the bracket member defining a post aperture for receiving a portion of the at least one support post, and at least a second one of the plurality of collapsible side panels of the collapsible crate comprises an aperture disposed therethrough for accommodating the bracket member of the first one of the plurality of collapsible side panels when the first one of the plurality of collapsible side panels is folded onto the second one of the plurality of collapsible side panels.

12. The clothing container and rack according to claim 11, wherein the second one of the plurality of collapsible side panels of the collapsible crate further comprises a notch formed in a top corner of the collapsible side panel, the notch configured to allow the second one of the plurality of collapsible side panels to be folded onto the bottom portion without being obstructed by the bracket member of the first one of the plurality of collapsible side panels.

13. The clothing container and rack according to claim 11, wherein the bracket member is integrally formed with the first one of the plurality of collapsible side panels.

14. The clothing container and rack according to claim 11, wherein the first one of the plurality of collapsible side panels of the collapsible crate further comprises an upper protrusion and the bottom portion of the collapsible crate comprises a recess for accommodating the upper protrusion of the first one of the plurality of collapsible side panels when the first one of the plurality of collapsible side panels is folded onto the bottom portion of the collapsible crate.

15. The clothing container and rack according to claim 11, wherein the bottom portion of the collapsible crate comprises at least one aperture disposed in the bottom portion, the at least one aperture of the bottom portion configured to accommodate a strap for securing the collapsible crate to the suitcase housing.

16. The clothing container and rack according to claim 11, wherein the bottom portion of the collapsible crate comprises a plurality of foot members, the plurality of foot members configured to operate as spacers for accommodating a retractable handle structure of the suitcase housing.

17. A clothing container and rack, comprising:

a collapsible crate having a plurality of collapsible side panels pivotably coupled to a bottom portion via hinge portions, the collapsible crate defining an interior cavity for holding one or more items of apparel; and a clothing rack configured to be attached to the collapsible crate, the clothing rack including a clothes rod for hanging one or more items of clothing;

wherein at least a first one of the plurality of collapsible side panels of the collapsible crate comprises a bracket member and the clothing rack further comprises at least one support post, the bracket member defining a post aperture for receiving a portion of the at least one support post.

18. The clothing container and rack according to claim 17, wherein at least another component of the collapsible crate comprises an aperture disposed therethrough for accommodating the bracket member of the first one of the plurality of collapsible side panels when the first one of the plurality of collapsible side panels is folded.

19. The clothing container and rack according to claim 17, wherein at least a second one of the plurality of collapsible side panels of the collapsible crate comprises a notch formed in a top corner of the collapsible side panel, the notch configured to allow the second one of the plurality of collapsible side panels to be folded onto the bottom portion without being obstructed by the bracket member of the first one of the plurality of collapsible side panels.

20. The clothing container and rack according to claim 17, wherein the bracket member is integrally formed with the first one of the plurality of collapsible side panels.

* * * * *